US011260278B2

(12) United States Patent
Wood et al.

(10) Patent No.: US 11,260,278 B2
(45) Date of Patent: Mar. 1, 2022

(54) GOLF CLUB GRIP WITH PRESSURE AID

(71) Applicant: Eaton Intelligent Power Limited, Dublin (IE)

(72) Inventors: Billy Dee Wood, Whispering Pines, NC (US); Gregory William Cavill, Pinehurst, NC (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/795,712

(22) Filed: Feb. 20, 2020

(65) Prior Publication Data

US 2020/0269103 A1 Aug. 27, 2020

Related U.S. Application Data

(60) Provisional application No. 62/808,350, filed on Feb. 21, 2019.

(51) Int. Cl.
*A63B 53/14* (2015.01)
*A63B 60/08* (2015.01)

(52) U.S. Cl.
CPC ..... *A63B 60/08* (2015.10); *A63B 53/14* (2013.01)

(58) Field of Classification Search
CPC ..... A63B 60/08; A63B 53/14; A63B 60/10; A63B 60/16; A63B 60/14; A63B 2225/62; A63B 2071/0694
See application file for complete search history.

(56) References Cited

U.S. PATENT DOCUMENTS

| | | | | | |
|---|---|---|---|---|---|
| 5,322,290 | A * | 6/1994 | Minami | A63B 53/14 | 473/201 |
| 5,897,440 | A * | 4/1999 | Bae | A63B 60/00 | 473/201 |
| 6,022,278 | A * | 2/2000 | Vela | A63B 53/14 | 473/201 |
| D430,634 | S * | 9/2000 | Cleveland | D21/756 | |
| D529,971 | S * | 10/2006 | Rose | D21/756 | |
| 7,458,903 | B2 * | 12/2008 | Wang | A63B 53/14 | 473/300 |
| 7,770,321 | B2 * | 8/2010 | Huang | A01K 87/08 | 43/23 |
| D648,411 | S * | 11/2011 | Lidenberg | D21/756 | |
| D660,388 | S * | 5/2012 | Gill | D21/756 | |
| D696,368 | S * | 12/2013 | Huang | D21/756 | |
| 8,801,530 | B2 * | 8/2014 | Beck | A63B 60/10 | 473/201 |

(Continued)

*Primary Examiner* — Stephen L Blau
(74) *Attorney, Agent, or Firm* — Fay Sharpe LLP

(57) ABSTRACT

A flexible grip for a golf club having a tubular member with one or more strips of elastomeric material significantly softer than the elastomeric material of the tubular member provided on the exterior surface of the tubular member. In one version, the strips are on the top flat surface, on other versions, the strips are on the side or both. In another version, an air pocket is provided beneath the strip on the top surface. In another version, a rib or key on a core bar forms a channel on the inner surface of the tubular member during molding. Upon removal of the core bar, a pocket is formed along the grip upon assembly on a club shaft. Upon gripping, the strips and pockets allow depression providing indication of grip pressure. The strips also provide visual aids for user hand positioning.

9 Claims, 4 Drawing Sheets

(56) References Cited

U.S. PATENT DOCUMENTS

| | | | | |
|---|---|---|---|---|
| D781,386 | S * | 3/2017 | Lamkin | D21/756 |
| 10,238,934 | B2 * | 3/2019 | Becktor | A63B 53/14 |
| 10,512,830 | B2 * | 12/2019 | Nicolette | A63B 60/24 |
| 10,912,973 | B2 * | 2/2021 | Rife | A63B 60/24 |
| 2002/0052248 | A1 * | 5/2002 | Chen | A63B 53/14 473/301 |
| 2003/0139223 | A1 * | 7/2003 | Ulrich | A63B 53/14 473/301 |
| 2006/0287123 | A1 * | 12/2006 | Wang | A63B 53/14 473/300 |
| 2009/0017935 | A1 * | 1/2009 | Wang | A63B 69/3632 473/300 |
| 2009/0205105 | A1 * | 8/2009 | Pinkart | A63B 71/0009 2/161.3 |
| 2010/0190569 | A1 * | 7/2010 | Chen | A63B 53/14 473/300 |
| 2013/0079174 | A1 * | 3/2013 | Gill | A63B 53/14 473/300 |
| 2013/0248089 | A1 * | 9/2013 | Su | B25G 1/10 156/192 |
| 2019/0232131 | A1 * | 8/2019 | Huang | A63B 53/14 |
| 2020/0360775 | A1 * | 11/2020 | Davis | A63B 60/14 |

* cited by examiner

GOLF CLUB GRIP WITH PRESSURE AID

BACKGROUND

The present disclosure relates in general to hand grips employed on the handles of implements intended to be moved or swung with speed and force, such as, for example, sledge hammers, axes, and sporting implements such as tennis racquets and golf clubs. The disclosure particularly relates to grips formed of elastomeric material and intended for the shaft of a golf club.

Heretofore, golf club grips have been provided with textured portions on the outer surface for enhancing gripping and providing for localized compression or "cushioning" to accommodate the contact pressure of the user's fingers and palm when gripping the club. Such textured portions have included depressed areas which may have portions extending transversely of the longitudinal axis of the grip or at a bias angle including configurations such as spiral or helical grooves.

The existing manufacture of such elastomeric grips for golf clubs employs molding either by compression or injection, and thus, the formation of the molds having reverse image surfaces for forming the textured surfaces on the molded grip, have limited the configuration of the textured surfaces in order to provide machining of the molds and removal of the molded grip subsequent to the molding operation.

The formation of the textured surfaces has heretofore provided for only a limited amount of localized "cushioning" or resilience, i.e., compression in response to the user's grip for enhancing the contact area of the user's palm and fingers with the grip and thus retention and pressure on the implement. Thus, it has been desired to improve the grip with dynamic feedback on grip pressure and alignment through visual aids for hand and finger placement guides and pressure aids to allow the user to self-adjust grip pressure for a smoother and more repeatable stroke.

SUMMARY

The present disclosure provides an improved elastomeric grip for an implement, and particularly for a golf club grip, formed from an elastomeric material having an open end and a substantially closed end. The disclosed grip is particularly applicable to putter grips. One disclosed version includes the grip material having a first hardness with a strip having a second hardness disposed within a cavity in the outer surface of the grip in a selected location on the grip for providing the user with a grip pressure aid and visual alignment aid.

In another version, the grip includes a plurality of channels with strips therein in selected locations in the grip for providing the user with grip pressure aids and hand placement guide.

In other versions, the strip may vary in length, width, and depth as well as location on the grip for greater sensitivity for indicating grip pressure and visual alignment for hand placement.

In still another version, the grip of the present disclosure is formed with an enclosed void or hollow space that may be filled with a gas, fluid, or foam material within a wall of the tubular member beneath the channel and strip to provide improved localized radial compressibility or "cushioning" for the grip to enhance deflection and to further lighten gripping pressure.

DETAILED DESCRIPTION

Figure 1:
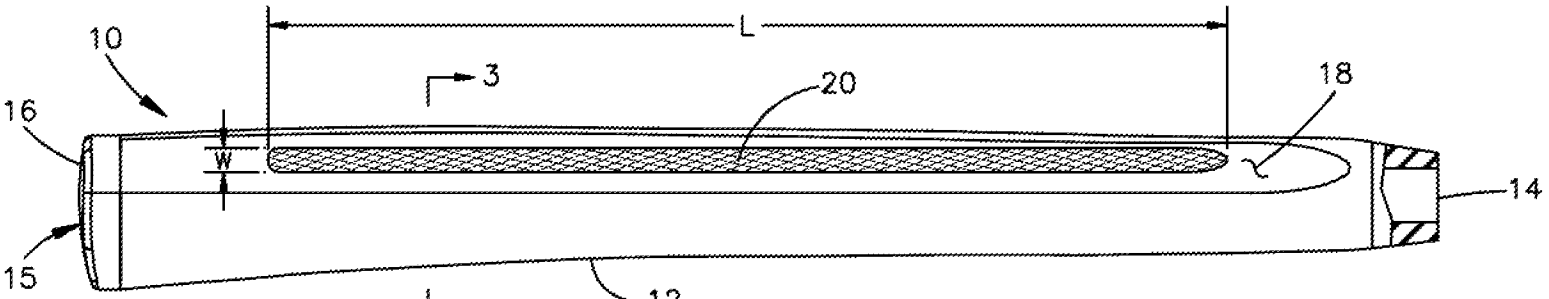
FIG. 1 is an enlarged perspective view of a grip according to the present disclosure.

Referring to the FIGURES, and first referring in particular to FIG. 1, there is depicted a grip, indicated generally at 10 in the form of a tubular member 12 having an open end 14 adapted to be received over an implement shaft (not shown) and an end indicated generally at 15 distal the open end 14, the distal end having a cap 16 disposed over the distal end together forming the grip 10 according to one version of the present disclosure. Grip 10 is typically made from a rubber or an elastomer that has a hardness value. The terms "elastomer" and "elastomeric", as used herein, are meant to include rubber or any rubber like material, elastomers, thermoplastic elastomers, polymers with a viscoelasticity, or combinations thereof.

The grip 10 depicted in FIG. 1 and the other FIGURES may be shaped for use on a golf putter which hereafter will be described in much greater detail. It will be understood that grip 10, according to the present disclosure, can have many forms and finds applicability to not only putter grips, but also to swing grips, and other hand grips for implements that impart shock from being swung with speed and force as previously mentioned herein.

Figure 6:
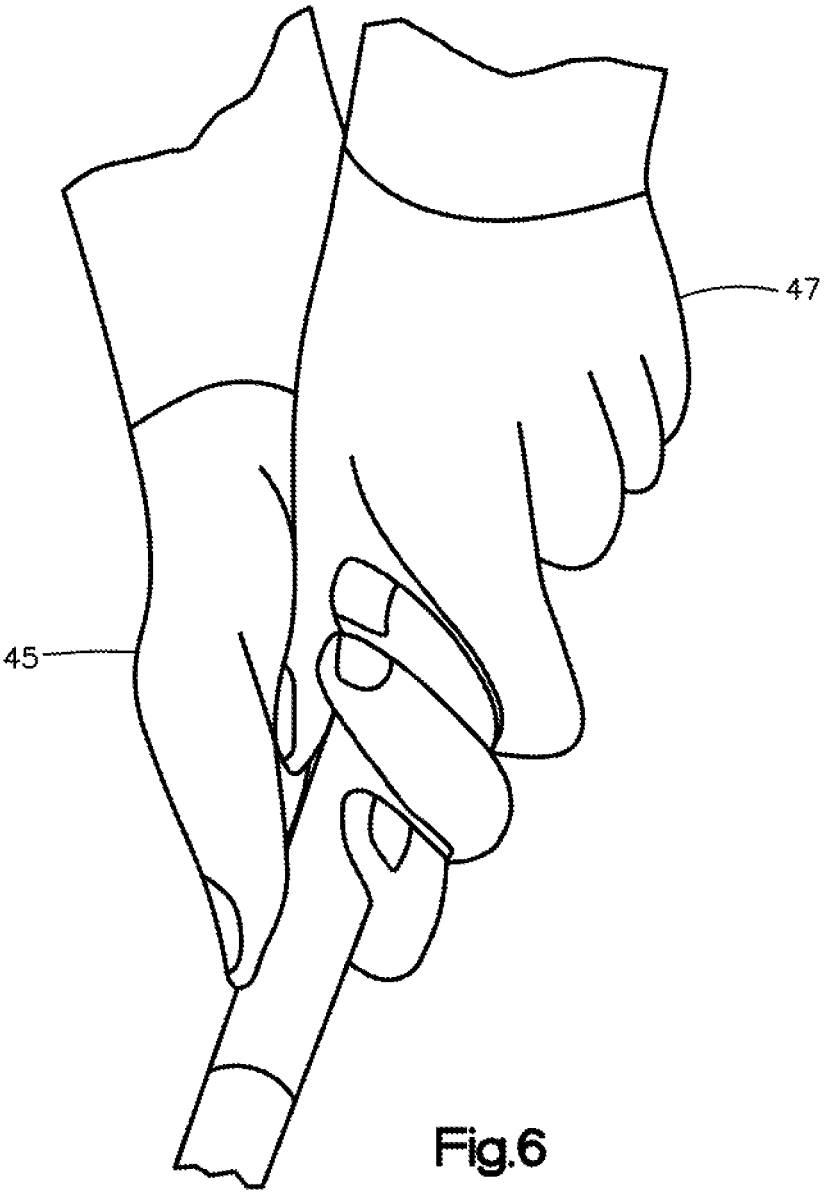
FIG. 6 is a perspective view showing users hand placement on a version of the grip of the present disclosure.

Grip 10 includes an elastomeric strip 20 molded in a flat surface 18 on the top or upper side of the grip 10. Strip 20 may be made of a similar elastomer to that used to form the grip 10 or may be made of a different elastomer molded into tubular member 12 of grip 10. Strip 20 is provided with a different hardness from that of the tubular member 12; and, strip 20 is positioned on an exterior or outer surface of tubular member 12 for providing the user with a grip pressure aid and also serves as a visual alignment aid. Because a putting stroke requires a light grip pressure for a smooth and repeatable stroke, the grip 10 has a particular suitability for a golf putter. Alternately, a plurality of strips 20 may be strategically positioned in localized areas on the grip 10 as pads that utilize different material firmness or hardness for providing localized depression in response to grip pressure and also serve as visual alignment aids for the golfer upon gripping a club, as shown in FIG. 6, for easily locating correct hand placement. The use of plural localized pads or strips 20 that can deflect or compress locally by various or different amounts depending upon the amount of pressure exerted upon them and their hardness values. By feeling the amount of depression or deflection, the user immediately receives a better assessment of grip pressure.

Figure 3:
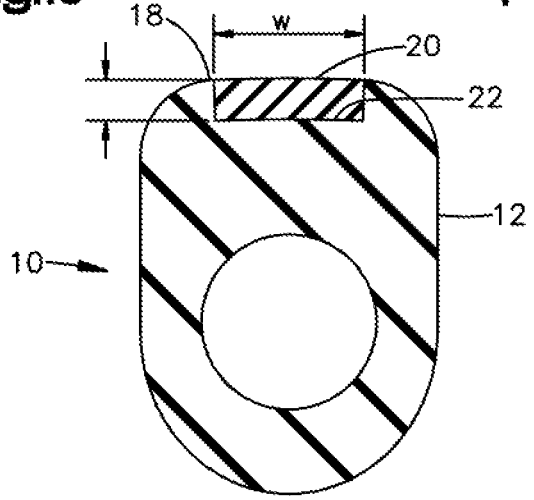
FIG. 3 is a sectional view taken along section indicating lines 3-3 of FIG. 1.

Referring to FIGS. 1 and 3, strip 20 may be placed in a cavity or channel 22, with a desired length L, width W, and depth D positioned in one or more areas in the tubular member 12; and, the strip 20 may be molded into the tubular member 12, or bonded in place with an adhesive. In the present practice, the strip 20 has a softer hardness value different from the base material of the tubular member 12. In the present practice, it has been found satisfactory to provide the strip 20 with a minimum of approximately ten (10) points Shore A hardness difference as compared to the tubular member's hardness. When a plurality of strips 20 are employed, each of the strips 20 may have the hardness value selected to deflect various amounts for a better indication of grip pressure.

Figure 2:
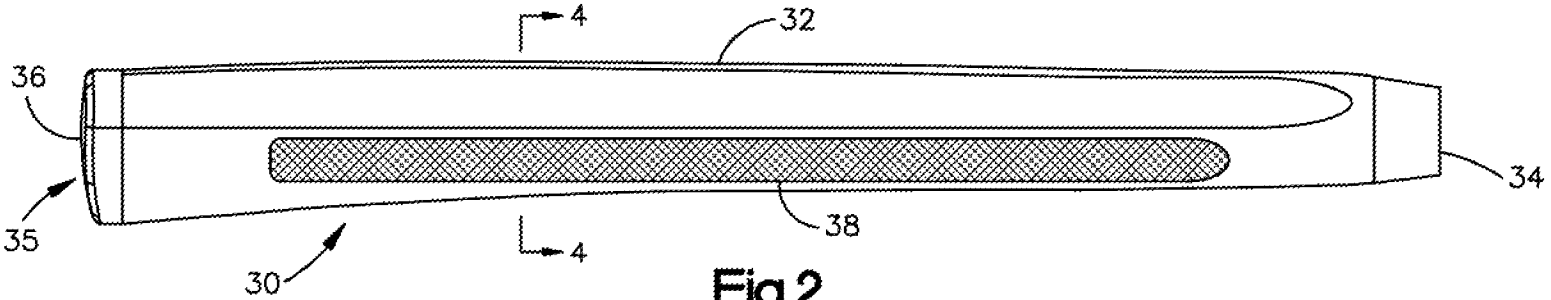
FIG. 2 is an enlarged perspective view from the side of another version of a grip according to the present disclosure.

The strips 20 may be molded along the axial length of the tubular members 12 as depicted in FIGS. 1 and 2, or at any circumferential or peripheral point or location on tubular members 12. The strip 20 on the front or top flat face 18 of the grip 10, as seen in FIG. 1, may have a minimum length L of approximately 89 mm (millimeters) and may be placed on the top face in the mid-section of grip 10 as illustrated in FIG. 1 in order for the golfer's thumb to rest thereupon and the strip 20 may have a maximum length as desired. Putter grips can vary in length in a range from about 250 mm and greater. In the present practice, the strip 20 has a minimum width of about 8 mm. This width W is chosen sufficient for a proper contact area with the fingertips of a user. If desired, multiple strips with these width and depth dimensions may be employed for creating the grip pressure indicator and the visual alignment aid where desired on the grip for various golfers.

The strip 20 may be provided on the top surface 18 or may be placed within a cavity or indentation 22 formed as a channel for receiving the strip 20 for molding therein. The channel or cavity on the front flat face or top of grip 10 as seen in FIG. 1, has a length L that ranges from a minimum of approximately 89 mm, and a width W ranging from a minimum of about 8 mm. The depth D of the cavity or channel may range from a minimum of about 3.5 mm and the configuration of the transverse section of the channel may take any desired shape or form. The strip 20 may conform with the cavity 22, but in other versions may not. Alternatively, the strip 20 may be placed directly on the outer surface of the tubular member 12.

Figure 4:
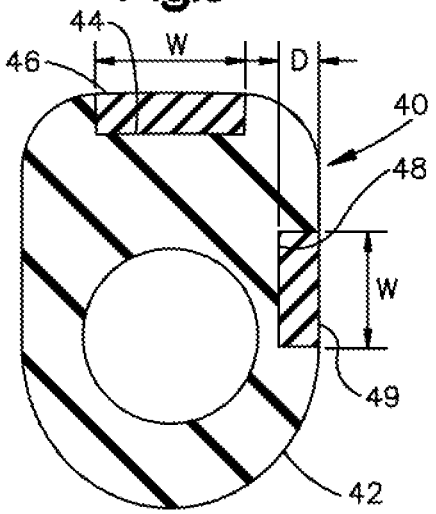
FIG. 4 is a sectional view taken along section indicating lines 4-4 of FIG. 2 illustrating the positioning of a strip on the side of the grip.

Referring to FIGS. 2 and 4, another version of a grip according to the present disclosure is indicated generally at 30 and includes a tubular elastomeric member 32 with an open end 34 and an end indicated generally at 35 distal the open end, with a cap 36 thereon. A strip 38, which may be similar to strip 20 of the version 10, is provided on the side of tubular member. Strip 38 may be molded on tubular member 32 or adhesively bonded thereon. In the present practice for version 30, it has been found satisfactory to provide a channel 39 in the side of tubular member 32 as shown in FIG. 4 with width W, length L and depth D into which strip 38 is received. The strip 38 may be molded in channel 39 or adhesively secured therein.

As seen in FIGS. 2 and 4, the strip may be placed on the side of the grip 10, and that placement may be on either side, or even both sides as desired with a minimum length L of approximately 76 mm.

Figure 5:
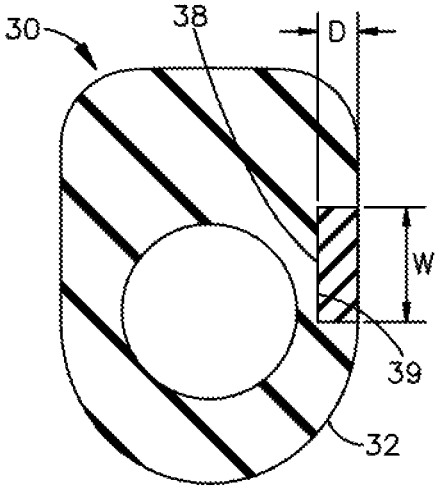
FIG. 5 is a transverse cross-sectional view of another version of the grip of the present disclosure having top and side channels with strips in both channels.

Referring to FIG. 5, another version of a grip indicated generally at 40 has an elastomeric tubular member 42, which may have material properties similar to tubular member 12. A channel 44 is formed in the top flat surface 46 of the tubular member 42 with an elastomeric strip 45 received in channel 44. Strip 46 may be similar to strip 20 of version 10 in material and dimensions L, W, and D. Version 40 also has a channel 48 formed on a side surface of tubular member 42 into which is received strip 49. Strip 49 may have properties and dimensions similar to strip 46; and, it may be molded in channel 48 or adhesively secured therein.

The grip pressure indicator feature of the present disclosure becomes more detectable as it is activated when the fingers are placed on top of the grip strips 20, 46, and the user's grip pressure increased. Furthermore, the grip strips 20, 46 may be made visually identifiable to the user prior to taking hold of the grip through employment of color, indicia, or texture on the strips 20, 46. Placement of the strips 20, 46 can be visual indicators to visually assist the user in positioning their hands to a more consistent position or a traditional position as shown in FIG. 7, and then upon the user placement of hands on the tubular member, act as a grip pressure indicator and limiter.

Figure 7:
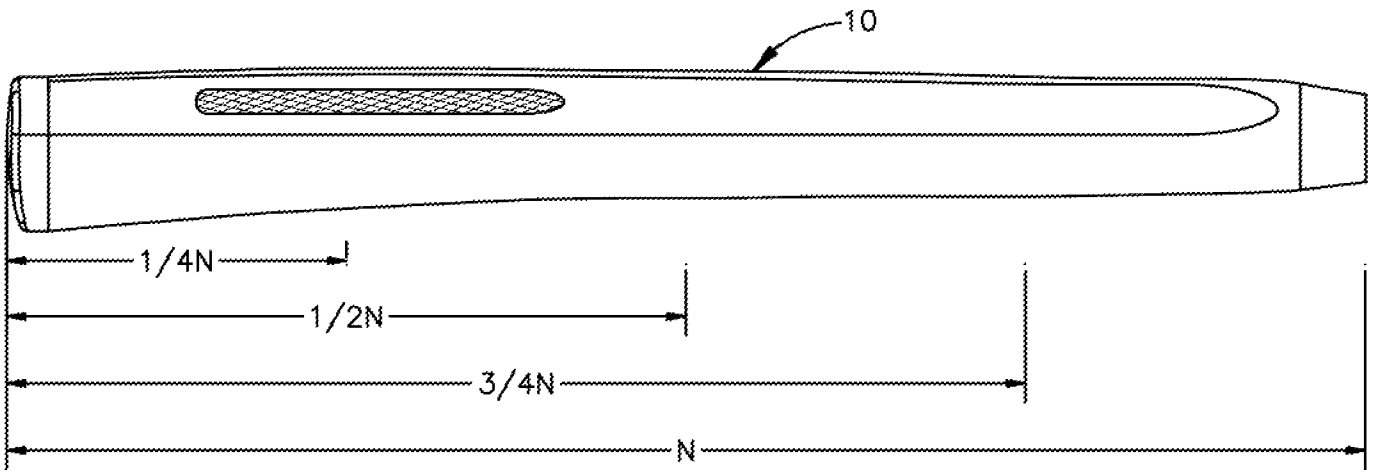
FIG. 7 is a perspective view of a grip illustrating the sections of the grip referred to herein.

Referring to FIG. 7, there is depicted a grip 10 with sections of the grip identified. If the full length of the grip 10 is a distance N, then the sections of the grip 10 may be designated a distance of ¼ N, ½ N, and ¾ N.

When a traditional gripping technique is employed as in FIG. 6, where a right handed user with a right handed putter grip is gripping the grip, the right hand 45, that is the dominate hand, is low on the grip; whereas, the left hand 47, the non-dominate hand, is high on the grip. In this arrangement, strips 38, 49 may be strategically positioned so that they are placed along the axial length of the grip, in the ¼ N, ½ N, and ¾ N sections with a minimum length of approximately 76 mm for the strips on sides of the grip 30, 40 in order for the fingertips from just one hand to rest upon the strips 38, 49. In another version, grips 30, 40 may be made with shorter pressure indicator strips 38, 49 that make contact with only one of the right hand or the left hand. The traditional or most commonly employed gripping technique places a golfer's more dominate hand 45 in the lower position and the less dominate hand 47 in the upper position. To avoid having to make grips specific to a right hand or left hand dominate grip, it is more economically viable to make the strips 38, 49 on the sides of the grip 30, 40 longer; and, in the present practice, it has been found satisfactory for strips 38, 49 to have a length of about 152 mm, to accommodate the hand positions of both left-handed and right-handed golfers. The longer strips 38, 49 on the side can also accommodate different gripping styles beyond the traditional technique, such as, a reversed grip where the user puts the dominate hand high and the less dominate hand low. Alternatively, there may be multiple strips on the same grip 30, 40 and on every side, including the bottom side (not shown) to accommodate additional non-traditional gripping techniques.

Figure 9:
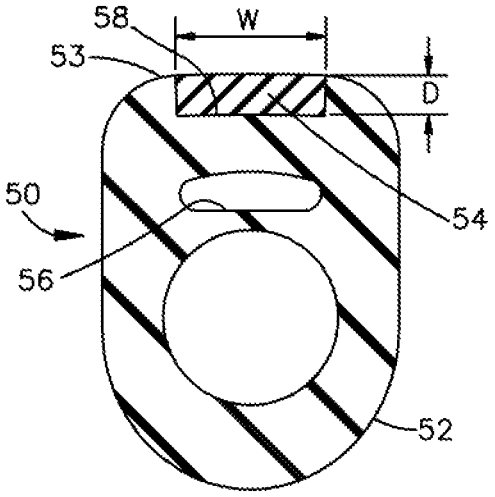
FIG. 9 is a cross-section of another embodiment of the present disclosure with a pocket or gap in the tubular member.
Figure 10:
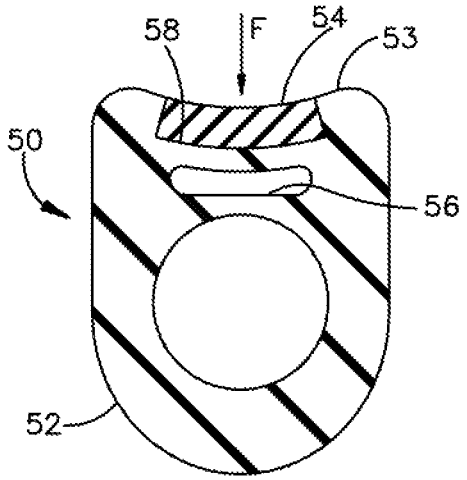
FIG. 10 is a sectional view similar to FIG. 9 illustrating the compressibility of the pocket or gap when the grip is subjected to a force F.

Referring now to FIGS. 9 and 10, another version of the grip of the present disclosure is indicated generally at 50 and has a void or pocket 56 formed therein situated below or adjacent a strip 54 received in a channel 58. Pocket 56 is disposed and configured in a manner that is capable of receiving a gas, such as air, nitrogen, or another gas, fluids, such as compressible fluids, or a foam material. Pocket 52 may be disposed immediately below a strip 54 or a selected distance below or adjacent strip 54; and, pocket 56 may extend the length and width of the strip 54, or of a lesser length or width for accommodating particular finger placement and serving as a grip pressure aid. Pocket 56 may provide an even softer pressure indicator, or alternatively a harder pressure indicator depending upon the nature of material disposed in the pocket 56. If desired, an exterior visual element that has painted grooves or other indicia may be employed to indicate the location of pocket 56. Alternatively, another soft pad or strip 54 may be bonded in place as an indicator. As shown in FIG. 10, upon application of a user applied force F from a thumb or finger of the user, to the strip 54, pocket 56 undergoes localized compression due to depression of the upper surface of the tubular member, or channel bottom if a channel is employed, as an indicator of the amount of pressure exerted thereon.

In the present practice, it has been found expeditious to form the various versions of the grip described hereinabove by molding or co-molding the strips 20 within the cavities, indentations, or channels 22, 39, 48, 58. However, it will be understood that other processes such as bonding, welding, or others such as additive manufacturing or 3D printing, may be employed.

Figure 8B:
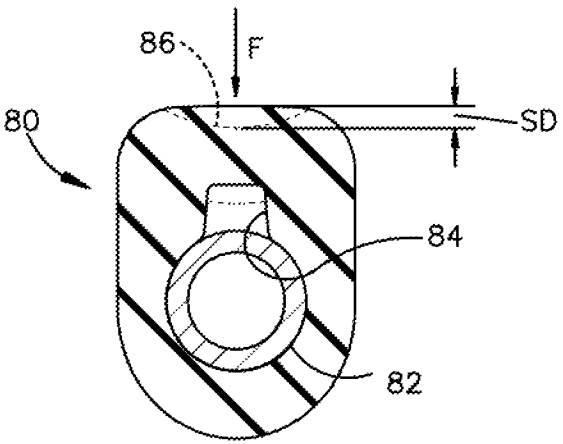
FIG. 8B is a cross-sectional view of the grip of FIG. 9 removed from the mold and assembled over a club shaft.
Figure 8A:
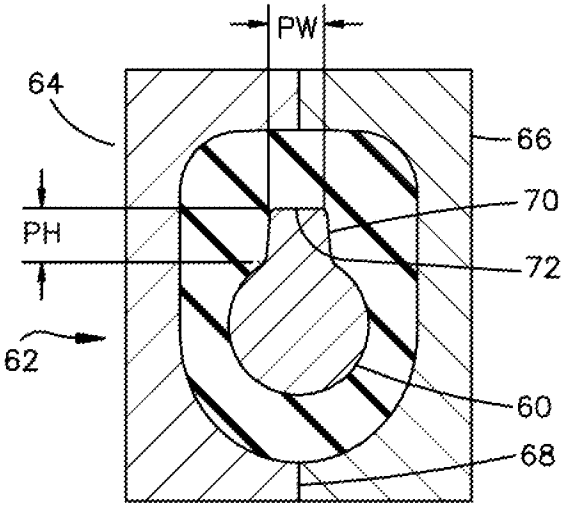
FIG. 8A is a transverse cross-sectional view illustrating another version of the grip of the present disclosure and method of forming a pocket in the grip in a mold.

FIG. 8A illustrates another version and method for forming a compressible pocket within a grip. A core bar 60 is positioned in a compression mold indicated generally at 62, with removable left and right sections 64, 66 respectively joined along parting line 68. Core bar 60 includes a protrusion or key 70 of a desired height PH and width PW which creates an internal channel 72 in the elastomeric material 74 disposed in mold 62 during the molding process.

Referring to FIG. 8B, the molded grip, indicated generally at 80, is shown in cross-section with mold sections 64, 66 and core bar 60 removed. The grip 80 is shown received on a shaft 82 of an implement such as a golf club. A pocket 84 is created between the club shaft and the internal surface of the grip 80. When a user gripping force F is applied to the upper surface of the grip, a surface deflection SD, shown in dashed line 86, is created which functions as a grip pressure indicator.

The exemplary versions are described and illustrated herein with reference to the drawings. Modifications and alterations will occur to others upon reading and understanding the preceding detailed description. It is intended that the embodiments be construed as including all such modifications and alterations insofar as they come within the scope of the appended claims or the equivalents thereof.

The invention claimed is:

1. A grip for an implement shaft, comprising:

(a) a tubular member formed of an elastomeric material having an open end adapted for being received over the implement shaft and an end distal the open end having a cap disposed over the distal end, the elastomeric material having a first hardness value;

(b) a channel formed in a selected location in an exterior surface of the tubular member, wherein the channel receives a strip of a second elastomeric material therein, the strip having a second hardness value different from the first hardness value of the tubular member; the second elastomeric material being indicative of hand placement on the grip, and the difference in hardness values being indicative of grip pressure, the strip has a hardness value with a minimum of approximately a 10 point Shore A hardness value difference softer than that of the hardness of the tubular member, a minimum length of approximately 89 mm, a minimum width of approximately 8 mm; and a minimum depth of approximately 3.5 mm.

2. The grip of claim 1, wherein the grip is a golf club grip.

3. The grip of claim 1, wherein the channel is located along the axial length of the grip on a top side of the grip with the strip disposed therein.

4. The grip of claim 3, wherein the top side of the grip includes the top being substantially flat.

5. The grip of claim 1, wherein the tubular member and the strip are made of a similar elastomer material.

6. The grip of claim 1, wherein the tubular member and the strip are made of dissimilar elastomer materials.

7. The grip of claim 1, wherein the strip is molded into the tubular member.

8. The grip of claim 1, wherein the strip is bonded into the tubular member with an adhesive.

9. The grip of claim 1, wherein the strip is placed on a top face of a mid-section of the grip in order for an associated thumb of an associated user of the grip can rest thereon.

* * * * *